US009500451B2

(12) United States Patent
Hultman

(10) Patent No.: US 9,500,451 B2
(45) Date of Patent: Nov. 22, 2016

(54) MUNITION WITH MULTIPLE PROPELLANT CHAMBERS

(71) Applicant: Safariland, LLC, Jacksonville, FL (US)

(72) Inventor: John Hultman, Casper, WY (US)

(73) Assignee: Safariland, LLC, Jacksonville, FL (US)

( * ) Notice: Subject to any disclaimer, the term of this patent is extended or adjusted under 35 U.S.C. 154(b) by 0 days.

(21) Appl. No.: 14/800,023

(22) Filed: Jul. 15, 2015

(65) Prior Publication Data

US 2016/0018201 A1 Jan. 21, 2016

Related U.S. Application Data

(60) Provisional application No. 62/025,146, filed on Jul. 16, 2014.

(51) Int. Cl.

| | |
|---|---|
| ***F42B 5/16*** | (2006.01) |
| ***F41A 1/06*** | (2006.01) |
| ***F42C 19/08*** | (2006.01) |

(52) U.S. Cl.

CPC . *F42B 5/16* (2013.01); *F41A 1/06* (2013.01); *F42C 19/083* (2013.01); *F42C 19/0834* (2013.01)

(58) Field of Classification Search

CPC ..... F42B 5/00; F42B 5/02; F42B 5/16; F42B 5/26; F42B 15/36; F42B 3/00; F42B 3/003; F42B 8/10; F42B 5/03; F42B 5/38; F42C 15/188; F42C 15/192; F42C 18/0823; F42C 18/084

USPC ..... 102/443, 447, 469, 470, 471, 472, 102/202.6, 204, 270

See application file for complete search history.

(56) References Cited

U.S. PATENT DOCUMENTS

| | | | | |
|---|---|---|---|---|
| 3,142,959 A | | 8/1964 | Klein | |
| 3,283,719 A | * | 11/1966 | Grandy | F42B 5/02 102/443 |
| 3,313,236 A | * | 4/1967 | Lohmann | F42C 15/188 102/256 |
| 3,994,233 A | * | 11/1976 | Travor | F42C 9/10 102/277.2 |
| 5,355,764 A | * | 10/1994 | Marinos | F42C 19/0811 102/472 |

(Continued)

FOREIGN PATENT DOCUMENTS

GB 253867 A 10/1926

OTHER PUBLICATIONS

PCT Application No. PCT/US2015/040687—International Search Report and Written Opinion dated May 19, 2016.

*Primary Examiner* — Bret Hayes
*Assistant Examiner* — Derrick Morgan
(74) *Attorney, Agent, or Firm* — Kane Kessler, P.C.; Paul E. Szabo

(57) ABSTRACT

A munition includes a projectile and a propellant unit. The propellant unit includes a shell having a cylindrical configuration centered on a longitudinal central axis of the munition. The shell has a cylinder opening that receives a cylinder. The cylinder is selectively rotatable in the cylinder opening about a cylinder axis, offset from the munition axis, between a plurality of firing positions. The cylinder has a plurality of propellant chambers each with a respective propellant charge. The propellant chambers are located in the cylinder so that when the cylinder is in a firing position one of the propellant chambers is on munition axis.

8 Claims, 3 Drawing Sheets

(56) References Cited

U.S. PATENT DOCUMENTS 5,880,397 A * 3/1999 Crilly ..... F42B 5/02 102/430
6,142,056 A * 11/2000 Taleyarkhan ..... B22D 11/148 102/440
6,502,514 B1 * 1/2003 Holler ..... F42C 19/10 102/204
8,618,455 B2 * 12/2013 Hultman ..... F42B 10/48 244/3.1
9,068,807 B1 * 6/2015 Thomas ..... F42B 15/10 102/370
9,200,876 B1 * 12/2015 Thomas ..... F42B 5/02
2012/0175456 A1 * 7/2012 Hultman ..... F42B 10/48 244/3.22
2015/0159981 A1 * 6/2015 Forbes ..... F42B 5/08 89/14.05
2016/0018201 A1 * 1/2016 Hultman ..... F42B 5/16 102/430

* cited by examiner

MUNITION WITH MULTIPLE PROPELLANT CHAMBERS

RELATED APPLICATION

This application claims priority to, and the benefit of the filing date of, U.S. Provisional Application No. 62/025,146 filed Jul. 16, 2014. This application incorporates by reference all the subject matter of said provisional application.

BACKGROUND OF THE INVENTION

Munitions are typically designed with a specific operational range, and for a single use. The range and usage are designed to deliver the maximum effect without compromising accuracy. This is accomplished by selectively setting the amount of propellant in the shell, or by altering the containment or shell base configuration. In this manner, manufacturers can offer the same round in multiple operational distances. While this broadens the overall product usage, it also forces the end user either to carry a single munition that may be either ineffective or unsafe, or to carry a large number of shells.

The present invention relates to a munition (cartridge) that includes a propellant unit capable of carrying multiple propellant charges of different capacities, thus allowing the munition's payload to be deployed at multiple engagement distances, or alternatively allowing the munition to be reloaded for more than a single use.

DETAILED DESCRIPTION

Figure 1:
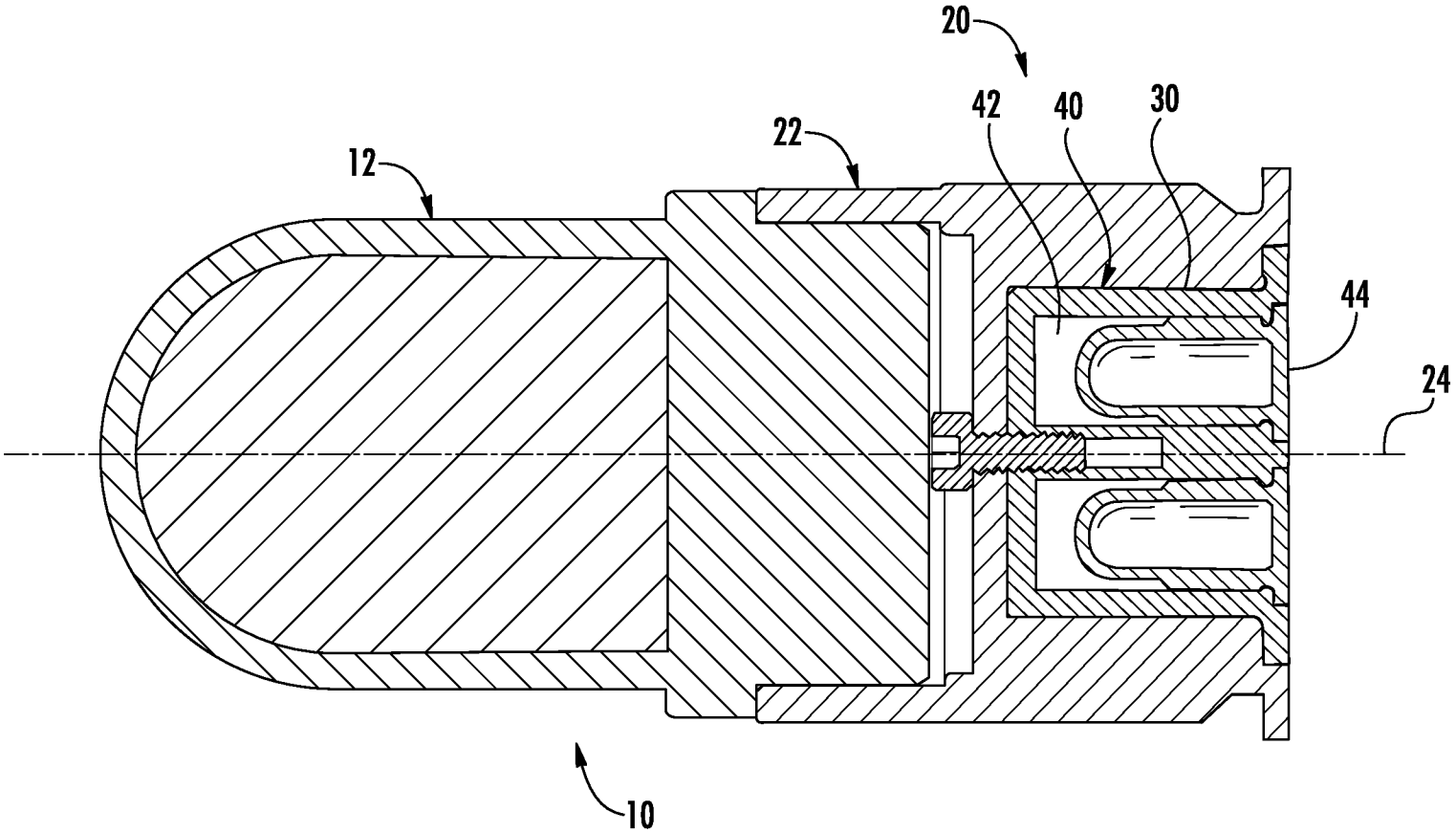
FIG. 1 is a schematic illustration of a munition that is a first embodiment of the invention, including a propellant unit and a projectile.
Figure 2:
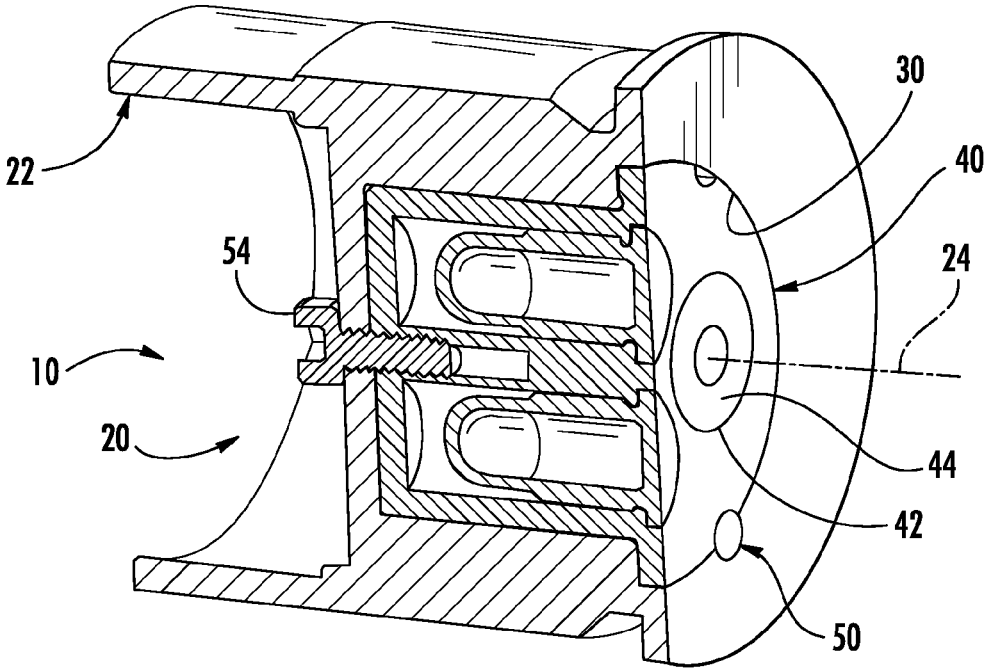
FIG. 2 is a cutaway perspective view of the propellant unit of FIG. 1.
Figure 3:
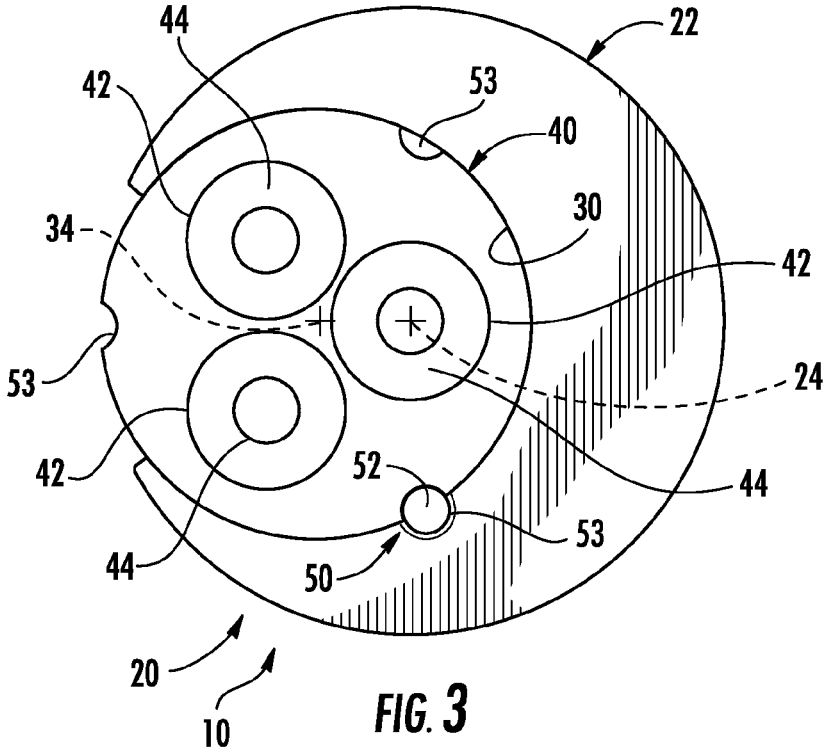
FIG. 3 is a schematic end view of the propellant unit of FIG. 1.

FIGS. 1-3 illustrate a munition 10 that is a first embodiment of the invention. The munition 10 includes a projectile, shown schematically at 12, that is releasably secured to a propellant unit 20. The propellant unit 20 is actuatable to produce gas under pressure to cause the projectile 12 to release from the propellant unit and travel along the barrel of a launcher (not shown) toward a target. The "launcher" can be any type of weapon or gun that can launch or project a projectile toward a target. One type of launcher with which a munition of the present invention can be used is the known 40 mm launcher that can launch a projectile containing tear gas or a marking agent, or another type of nonlethal projectile. The launcher has a chamber that receives the munition, and a barrel. When the launcher is fired, the propellant unit 20 is actuated, the propellant unit remains in the chamber of the launcher, and the projectile travels along the barrel and exits the barrel to move toward the target.

The propellant unit 20 (FIGS. 2-3) includes a shell base or shell 22. The shell base 22 houses or supports the other components of the propellant unit 20. It can be made from plastic or metal, and in calibers ranging from sub-inch to inch-plus. The shell base 22 has a cylindrical configuration centered on a longitudinal central axis, or munition axis 24, of the munition 10. When the munition 10 is inserted into the chamber of the launcher, the munition axis 24 is centered radially in the chamber.

The shell base 22 has a cylinder opening 30. In the embodiment of FIGS. 1-3, the cylinder opening 30 has a cylindrical configuration centered on a cylinder axis 34 that extends parallel to the munition axis 24. The cylinder axis 34 is not coincident with the munition axis 24, but rather is spaced apart radially from the munition axis. As a result, the cylinder opening 30 is eccentric from (or eccentric relative to, or offset from) the munition axis 24 of the munition, by a first distance.

The propellant unit 20 includes a propellant insert or cylinder 40. The cylinder 40 is cylindrical in configuration and is closely fitted in the cylinder opening 30 of the shell base 22. The cylinder 40 is rotatable within the cylinder opening 30, about the cylinder axis 34.

The cylinder 40 has within it a plurality of propellant chambers 42. The propellant chambers 42 are disposed in a circular array centered on the cylinder axis 34. The radial distance between the cylinder axis 34 and the centers of the propellant chambers 42 is the same as the first distance between the cylinder axis 34 and the munition axis 24.

Figure 4:
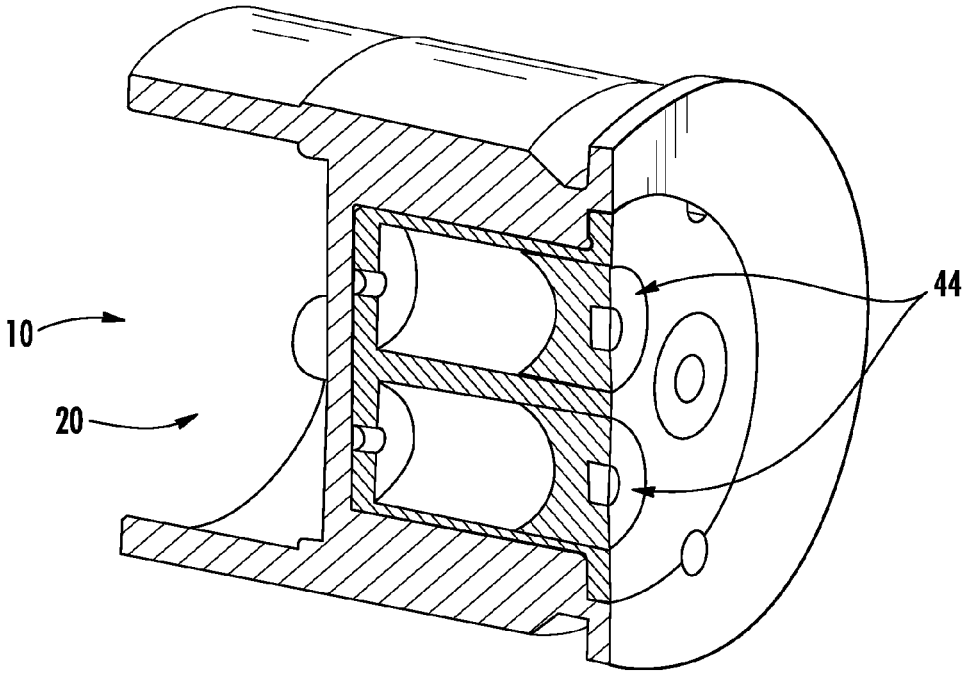
FIG. 4 is a cutaway perspective view of a propellant unit that is a second embodiment of the invention.

The munition 10 when assembled includes one or more propellant charges, indicated schematically at 44, that are actuatable to produce gas under pressure. The propellant charges 44 may be preformed cartridges as shown in FIG. 2, or may be loaded as individual components into the propellant chambers of the cylinder as shown in FIG. 4. Each propellant chamber 42 receives an individual propellant charge 44. The propellant unit 20 also includes a sealing ring (not shown) that acts as a gasket between the cylinder and the shell base 22.

The propellant unit 20 also includes an index assembly 50. The index assembly 50 includes a small pin 52 located on the circumference of the cylinder, engageable in a selected depression in the cylinder 40, and a compression spring (not shown). The index assembly 50 provides a means to lock or maintain the rotational position of the cylinder 40 at selected index locations within the shell base 22. A mechanical fastener 54 holds the cylinder in axial position within the shell base 22.

The cylinder 40 is selectively rotatable within the base 22. Because of the dimensions and locations of the propellant chambers 42, the cylinder axis 34, the munition axis 24, and the index assembly 50, when the cylinder 40 is rotated within the shell base 22 and stops in an index position, the selected propellant charge 44 is centered on the munition axis and is thus in a position to direct combustion products against the projectile 12. To change the munition 10 to a different propellant, the operator depresses and holds down the index pin 52 using a small screwdriver or similar tool. With the pin 52 depressed, the cylinder 40 can be rotated around the cylinder axis 34. Once this rotation starts, the index pin 52 no longer needs to be held down, because the geometry of the parts keeps the spring compressed until the next depression 53 is reached. Once the selected alignment is achieved, the index pin 52 pops into position, centering the desired propellant charge 44, now readied for use.

The selectabilty of the propellant charge 44 can be beneficial in several ways. First, the munition 10 may have an operator selectable effective munition range, by providing different strength propellant charges 44. The operator can index the munition 10 to select a predetermined propellant charge 44 that best meets the operational needs, with each charge having a different propellant volume or type. For example, the munition 10 can be configured to propel a given payload (projectile) at distances of 400, 600, or 800 meters, depending on which propellant charge 44 is selected. A single munition 10 can thus fill the operational role of two or more independent munitions. This ability diversifies the operator's engagement capability, while increasing mobility by reducing the weight of equipment that must be carried by the operator.

Alternatively, the munition 10 can be configured for use as a multi-use munition. Plural, identical propellant charges 44 can be provided in the propellant unit 20, to provide for repeatable payload performance. The propellant unit 20 can be reloaded with a new projectile 12 two or more times, reducing bulk weight and reducing end user cost. After each shot, the operator simply replaces the projectile 12 and indexes the propellant unite 20 to the next unused position.

In the second embodiment, shown in FIG. 4, the propellant charges are not self-contained cartridges, as in the embodiment of FIGS. 1-3, but rather include elements that are individually loaded or packed into the propellant chambers.

Figure 5:
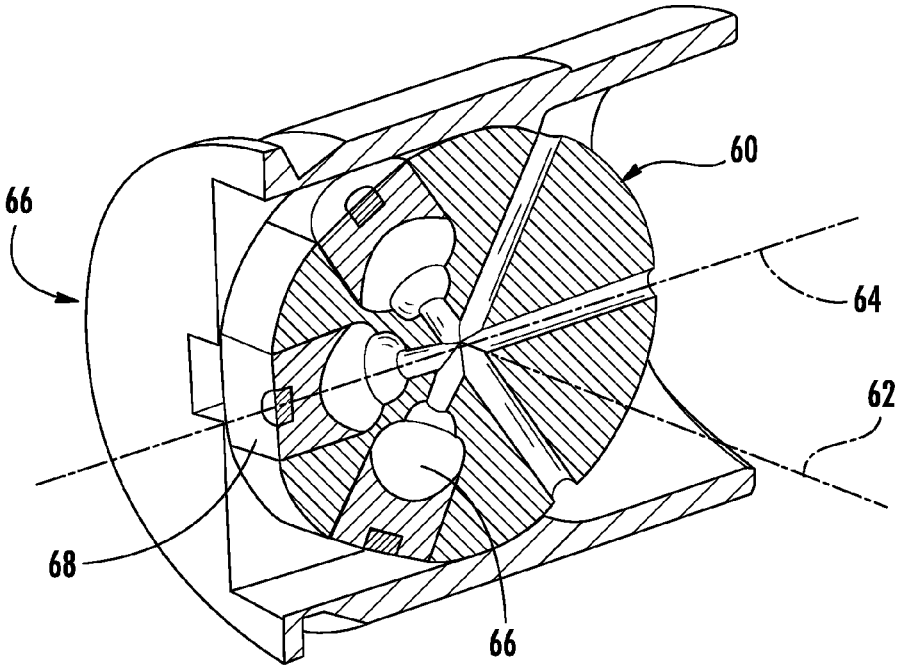
FIG. 5 is a cutaway perspective view of a propellant unit that is a third embodiment of the invention.

The embodiment of the invention that is shown in FIG. 5, is constructed with a cylinder 60 having a rotational axis 62 that extends perpendicular to the longitudinal central axis 64 of the munition 66. Radially extending propellant chambers 68, disposed in a circular array centered on the axis 62, house the propellant charges 70. Again, the propellant charges may be the same strength as each other, or may be different strengths from each other.

From the foregoing description, those skilled in the art will perceive improvements, changes, and modifications in the invention. Such improvements, changes, and modifications within the skill of the art are intended to be covered by the appended claims.

The invention claimed is:

1. A munition receivable in a chamber of a projectile launcher, the munition comprising:

a projectile; and a propellant unit that is actuatable to produce gas under pressure, the projectile being releasably connected with the propellant unit and receiving force of the gas under pressure to cause the projectile to release from the propellant unit and travel from the launcher toward a target, the propellant unit comprising:

a shell having a cylindrical configuration centered on a longitudinal central axis of the munition;

the shell having a cylinder opening, the cylinder opening having an cylinder axis that is not coincident with the longitudinal central axis of the munition; and a cylinder received in the cylinder opening of the shell and being selectively rotatable in the cylinder opening about the cylinder axis between a plurality of firing positions;

the cylinder having a plurality of propellant chambers each receiving a respective propellant charge and a respective primer, the propellant chambers being located in the cylinder so that when the cylinder is rotated to a firing position one of the propellant chambers with the respective propellant charge including the respective primer rotates to and is centered on the longitudinal central axis of the munition.

2. A munition as set forth in claim 1 wherein the propellant chambers are disposed in a circular array centered on the cylinder axis.

3. A munition as set forth in claim 2 wherein the radial distance between the cylinder axis and the propellant chambers is the same as the distance between the cylinder axis and the munition axis.

4. A munition as set forth in claim 3 wherein the cylinder axis is parallel to but spaced apart from the munition axis.

5. A munition as set forth in claim 3 wherein the cylinder axis is perpendicular to the munition axis.

6. A munition as set forth in claim 3 wherein the propellant charges are the same strength as each other.

7. A munition as set forth in claim 3 wherein the propellant charges are different strengths from each other.

8. A munition as set forth in claim 2 further comprising an index assembly acting between the cylinder and the shell for holding the cylinder in a selected firing position in the cylinder opening:

the index assembly comprising a pin located on a radially extending end face of the munition, the pin being engageable in a depression in the cylinder, the index mechanism being operable by depressing the pin using a tool.

* * * * *